US006878175B2

(12) United States Patent
Keller et al.

(10) Patent No.: US 6,878,175 B2
(45) Date of Patent: Apr. 12, 2005

(54) GREASE FILTER

(75) Inventors: Hans Gerd Keller, Sundern (DE); Gert Meinhardt, Gondelsheim (DE)

(73) Assignee: BSH Bosch und Siemens Hausgerate GmbH, Munich (DE)

( * ) Notice: Subject to any disclaimer, the term of this patent is extended or adjusted under 35 U.S.C. 154(b) by 0 days.

(21) Appl. No.: 10/639,706

(22) Filed: Aug. 12, 2003

(65) Prior Publication Data

US 2004/0083693 A1 May 6, 2004

Related U.S. Application Data

(63) Continuation of application No. PCT/EP02/01288, filed on Feb. 7, 2002.

(30) Foreign Application Priority Data

Feb. 12, 2001 (DE) ..... 101 06 307

(51) Int. Cl.[7] ..... B01D 50/00

(52) U.S. Cl. ..... 55/320; 55/322; 55/444; 55/511; 55/DIG. 36

(58) Field of Search ..... 55/320, 321, 322, 55/325, 444, 511, DIG. 36

(56) References Cited

U.S. PATENT DOCUMENTS 3,910,782 A 10/1975 Struble et al.
5,178,654 A 1/1993 Cowley et al.
5,302,174 A * 4/1994 Guetersloh ..... 55/444

FOREIGN PATENT DOCUMENTS

| | | |
|---|---|---|
| DE | 27 20 201 C2 | 11/1978 |
| DE | 41 38 846 A1 | 5/1993 |
| DE | 44 27 074 A1 | 2/1996 |
| DE | 298 11 000 U1 | 10/1998 |
| DE | 299 06 295 U1 | 9/1999 |

* cited by examiner

*Primary Examiner*—Robert A. Hopkins
(74) *Attorney, Agent, or Firm*—John T. Winburn; Russell W. Warnock; Craig J. Loest

(57) ABSTRACT

A grease filter made from metal, in particular, for use in commercial kitchens and in household vapor extractor hoods has impact filter elements with a first row of elongate profiles disposed at distances from one another and with a second row of profiles disposed at distances from one another, the profile rows being at a distance from one another and being offset relative to one another such that the profiles of the second row match with the distances between the first row. A knitted fabric filter or an expanded mesh grid is disposed between the first and second rows of profiles. The profiles have a sound-absorbing material, in particular, sound-absorbing mats, on a side facing away from the air flow. By virtue of this configuration, a high grease efficiency is achieved, there is excellent protection against flame puncture, and noise protection measures can be implemented.

19 Claims, 2 Drawing Sheets

GREASE FILTER

CROSS-REFERENCE TO RELATED APPLICATION

This application is a continuation of copending International Application No. PCT/EP02/01288, filed Feb. 7, 2002, which designated the United States and was not published in English.

BACKGROUND OF THE INVENTION

Field of the Invention

The invention relates to a grease filter made from metal, in particular, for use in commercial kitchens and in household vapor extractor hoods.

Grease filters of this type are known. They have a first row of profiles disposed at distances from one another and open in the direction of the gas flow and also a second row of profiles disposed at distances from one another and open opposite to the direction of the gas flow, the mutually adjacent longitudinal edges of two juxtaposed profiles of one row projecting in each case into the inner space of an opposite profile of the other row.

Filters of this type are described in German Patent DE 27 20 201 C2 and U.S. Pat. No. 3,910,782 to Struble et al. (hereinafter "Struble"). In the Struble separation grids, the distance between the two profile rows is dimensioned such that the air flowing through experiences a multiple reversal of direction. The free passage cross-section is 10–30% of the entire grid area, depending on the type of separation grid. As a result of this reduction in cross-section within the separation grid, an increase in the air velocity of 3–10 times occurs. The separating action of the grid is based on this velocity increase. As a result, the liquid droplets and solid particles contained in the air are, of course, also accelerated, and on the multiple reversal in direction of the air flowing through. The accelerated liquid droplets and solid particles cannot follow the change in direction and impinge onto the inner surface of the profiles of the second row. The liquid droplets form on its surface a liquid film that is intended gradually to run off downward and pass through special orifices in the frame of the separation grid into a collecting rail disposed below the separation grid.

Due to the oblique position of the separation grids in the extractor hoods, the liquid film does not, for the large part, run downward in the profile direction, as desired, but, instead, even after a short travel, arrives at the two edges of the profiles. There, the liquid film is intercepted by the air flowing through between the profiles at a high velocity. Depending on the kinematic viscosity of the liquid film, particles of greater or lesser size are torn out of the liquid film and, thus, enter the spent-air stream. The desired separating action is absent or is greatly impaired.

It is proposed, in German Published, Non-Prosecuted Patent Application DE 44 27 074 A1, that the longitudinal edges of the profiles of the second row be bent inward to form gutters such that, when the separation grid is in operation, these gutters form dead-flow spaces in which a drainage of the separated particles takes place.

It, then, became known from German Utility Model DE 299 06 295 U1 to configure an additional filter as a unit mechanically releasable from the air vortex filter. The additional filter is of a knitted fabric filter and is disposed behind the tray-shaped elongate guide plates. Due to the releasable connection to the air vortex filter, the additional filter is removable and can be cleaned or exchanged.

Contrary to this direction of development, German Utility Model DE 298 11 000 U1 proposes a grease trap filter using two or more layers of a grid that has slot bridges produced on both sides of a plate by a punching operation, the grids being disposed within the filter such that the slot bridges run vertically or obliquely downward, and the grids being held together by a common frame. A further grid, the slot bridges of which are disposed horizontally, may be located in each case between two grids having slot bridges running vertically or obliquely downward.

The disadvantage of these filter configurations is that the impact filters have only insufficient grease efficiency, and the following releasable knitted fabric filter insert according to German Utility Model DE 299 06 295 U1, in turn, provides only insufficient protection against flame puncture. Furthermore, here, a measurement transducer is disposed, which is intended to cause signal emission dependent on differential pressure. This signifies additional outlay in measurement terms, and the safety actually capable of being achieved is dubious.

In addition, these filter configuration do not leave any latitude for secondary noise protection measures.

SUMMARY OF THE INVENTION

It is accordingly an object of the invention to provide a grease filter that overcomes the hereinafore-mentioned disadvantages of the heretofore-known devices of this general type and that combines the advantages of impact and knitted fabric filters with high protection against flame puncture.

With the foregoing and other objects in view, there is provided, in accordance with the invention, a grease filter, including impact filter elements having a first row of elongate profiles disposed at distances from one another, a second row of profiles disposed at distances from one another, and at least one filter selected from the group consisting of a knitted fabric filter and an expanded mesh grid, the at least one filter being disposed between the first and second rows of profiles, and the first and second rows of profiles being disposed at a distance from one another and being offset relative to one another to match the profiles of the second row with the distances between the profiles of the first row.

A grease filter has impact filter elements with a first row of elongate profiles disposed at distances from one another and a second row of profiles disposed at distances from one another, the profile rows are at a distance from one another and are offset relative to one another such that the profiles of the second row match with the distances between the first row, and, has at least one knitted fabric filter or an expanded mesh grid, the knitted fabric filter or the expanded mesh grid being disposed between the first row of profiles and the second row of profiles. Accordingly, high grease efficiency is achieved, there is excellent protection against flame puncture, and noise protection measures can be implemented favorably.

In accordance with another feature of the invention, one of the profiles of the first row and the profiles of the second row are disposed on a downstream side of the impact filter elements with respect to an air flow direction and at least some of the profiles on the downstream side have sound-absorbing material.

For noise protection, in accordance with a further feature of the invention, the invention provides for the profiles of the second row to have sound-absorbing material, in particular, sound-absorbing mats, on the side facing away from the airflow.

In accordance with an added feature of the invention, the rows of profiles and the knitted fabric filter or the expanded mesh grid have a common frame or for the knitted fabric filter or the expanded mesh grid have a frame that can be pushed into the common frame. This is convenient for assembly and allows an easy exchange of the filter as a whole or of the knitted fabric filter or expanded mesh grid.

Furthermore, in accordance with an additional feature of the invention, the invention provides for the thickness of the knitted fabric filter or of the expanded mesh grid to be dimensioned such that, in the assembled state, the profiles of the first row and/or the profiles of the second row bear against the knitted fabric filter or expanded mesh grid. Such a configuration prevents grease droplets from dripping off from the profiles and from being entrained by the air stream.

It is advantageous, furthermore, in accordance with yet another feature of the invention, if the first row of profiles and/or the second row of profiles are trough-shaped, the longitudinal edges pointing in each case in the direction of the knitted fabric filter or of the expanded mesh grid. In such a case, the profiles of the first row and the profiles of the second row may overlap one another in their edge regions, while, at the same time, maintaining a distance for the knitted fabric filter or the expanded mesh grid.

In such a configuration, the knitted fabric filter or the expanded mesh grid is, preferably, disposed in a meander-shaped manner between the profiles of the first row and the profiles of the second row. It is expedient, at the same time, if, in each case in the edge region of the profiles of the first row, there is a change to the edge of that profile of the second row that lies behind. The grease droplets collected in the knitted fabric filter or expanded mesh grid can, thus, be guided in a defined manner into the bottom trough profile of the first profile row.

With the objects of the invention in view, there is also provided a grease filter, including at least one impact filter element having a filter flow direction, a first row of elongate profiles separated from one another to define first spaces therebetween, a second row of profiles separated from one another to define second spaces therebetween, and at least one filter selected from the group consisting of a knitted fabric filter and an expanded mesh grid, the at least one filter being disposed between the first and second rows of profiles, and the first and second rows of profiles being disposed at a distance from one another and being offset relative to one another to align the profiles of the second row with the first spaces in the filter flow direction.

Other features that are considered as characteristic for the invention are set forth in the appended claims.

Although the invention is illustrated and described herein as embodied in a grease filter, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
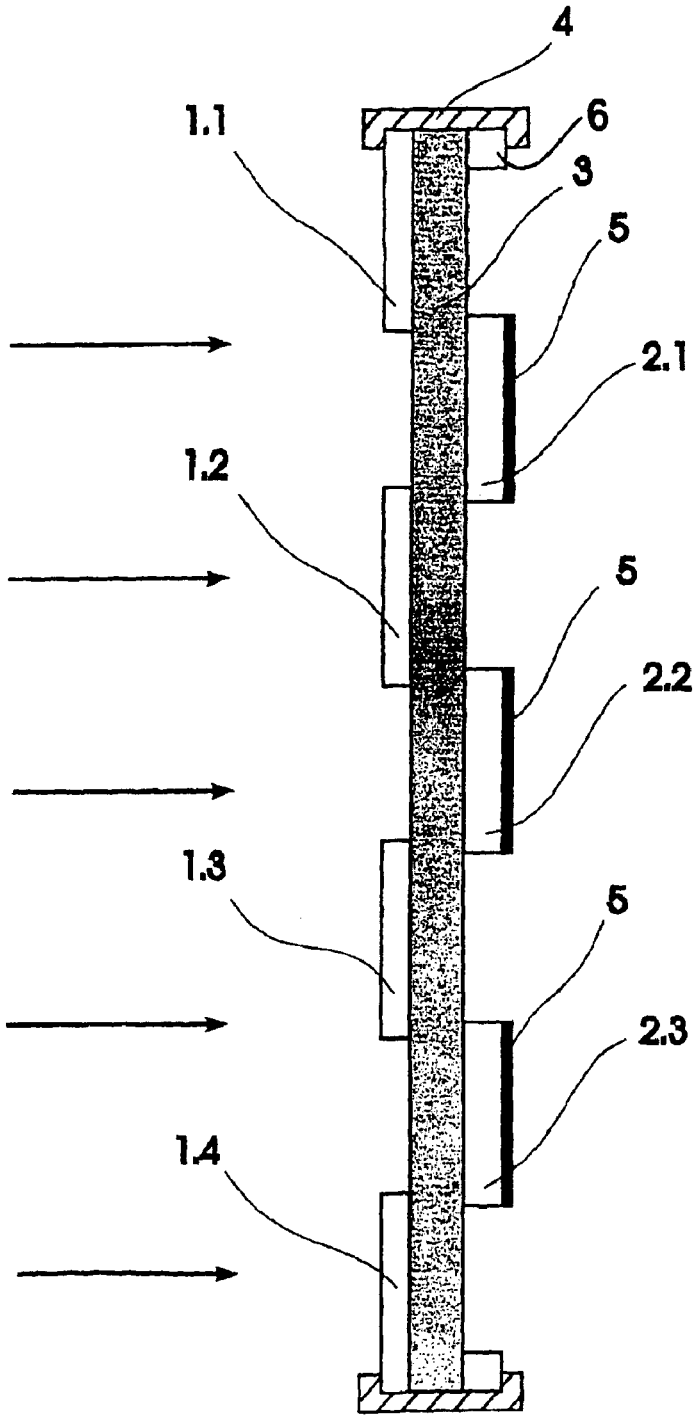
FIG. 1 is a diagrammatic cross-sectional view of a grease filter according to the invention.

Referring now to the figures of the drawings in detail and first, particularly to FIG. 1 thereof, there is shown a diagrammatic representation of a set-up of a grease filter according to the invention. The impact filter elements have a first row of elongate profiles 1.1 to 1.4 disposed at distances from one another and also of a second row of profiles 2.1 to 2.3 disposed at distances from one another, the profile rows being at a distance from one another and being offset relative to one another such that the profiles of the second row match with the distances between the first row.

A knitted fabric filter 3 or, alternatively, an expanded mesh grid is disposed between the first row of profiles 1.1 to 1.4 and the second row of profiles 2.1 to 2.3. The rows of profiles 1.1 to 1.4 and 2.1 to 2.3 and the knitted fabric filter 3 possess a common frame 4. It is also possible for the knitted fabric filter or the expanded mesh grid to have a frame 6 that can be pushed into the common frame 4.

In the version illustrated, the profiles 2.1 to 2.3 of the second row are coated with a sound-absorbing material, to be precise sound-absorbing mats 5, on the side facing away from the air flow.

By virtue of special designs of the profiles 1.1 to 1.4 and/or 2.1 to 2.3 and of the dimensioning of the knitted fabric filter 3 or of the expanded mesh grid, modifications of the grease filter according to the invention can be achieved.

Thus, in a special refinement, the invention provides for the thickness of the knitted fabric filter 3 or of the expanded mesh grid to be dimensioned such that, in the assembled state, the profiles 1.1 to 1.4 of the first row and/or the profiles 2.1 to 2.3 of the second row bear on the knitted fabric filter 3. Grease droplets are, thus, diverted directly into the knitted fabric filter 3 or expanded mesh grid and cannot drip off. By the inclining the grease filter, the knitted fabric filter 3 or the expanded mesh grid may serve as a run-off guide.

Figure 2:
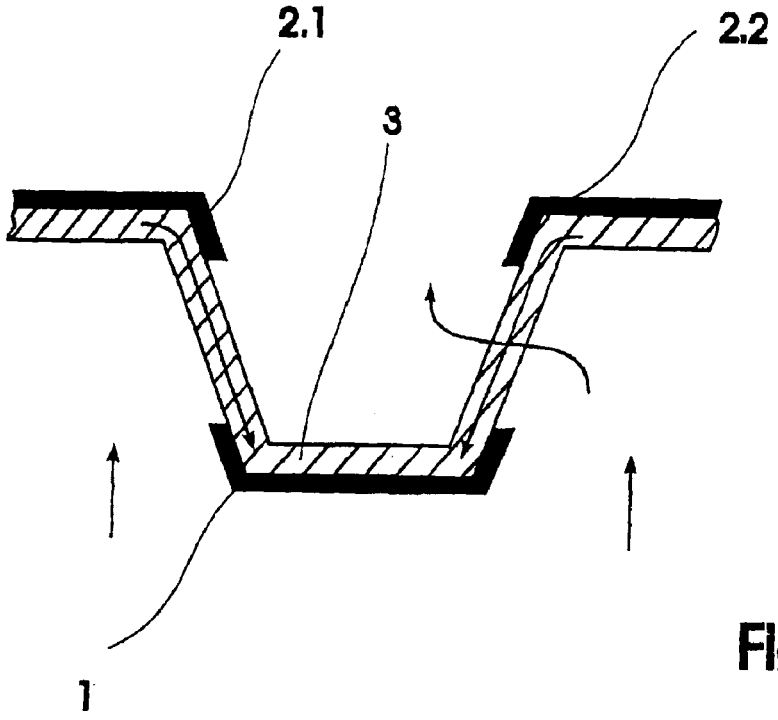
FIG. 2 is a fragmentary, cross-sectional view of a meander-shaped configuration of the knitted fabric filter or expanded mesh grid of FIG. 1.

FIG. 2 shows a detail of a configuration of the grease filter, in which the first row of profiles 1 and the second row of profiles 2.1–2.2 are trough-shaped, the longitudinal edges in each case pointing in the direction of the knitted fabric filter 3 or of the expanded mesh grid.

In such a case, the profiles 1 and the profiles 2.1 and 2.2 may overlap one another in their edge regions, while at the same time maintaining a distance for the knitted fabric filter 3 or the expanded mesh grid. The knitted fabric filter 3 or the expanded mesh grid are disposed, here, in a meander-shaped manner between the profiles 1 and 2.1 or 2.2, in that, in the edge region of the profile 1, there is a change to the edge of the profile 2.1 or 2.2 lying behind, and this is continued over the width of the grease filter.

The grease droplets collected in the knitted fabric filter 3 or expanded mesh grid can, thus, be guided in a defined manner into the bottom trough profile of the first profile row.

Figure 3:
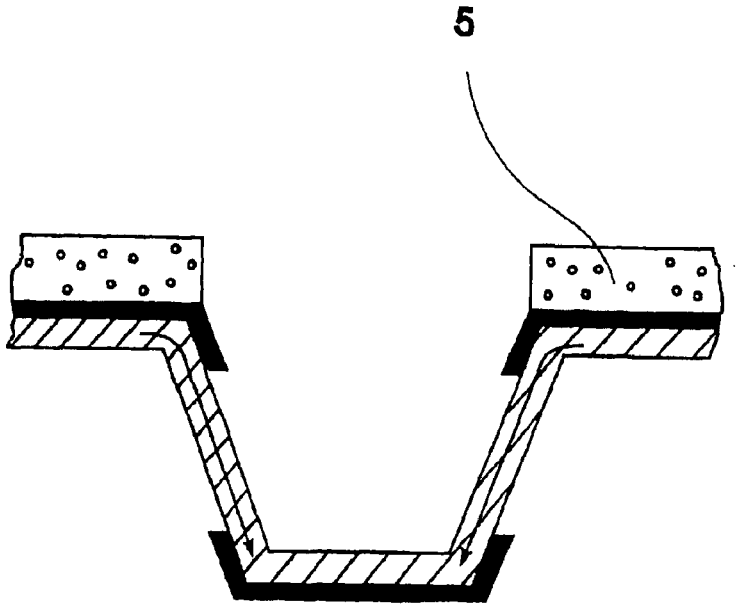
FIG. 3 is a fragmentary, cross-sectional view of the filter of FIG. 2 with sound insulation.

In FIG. 3, in the case of a meander-shaped configuration of the knitted fabric filter or expanded mesh grid, a sound-absorbing material, in particular, sound-absorbing mats 5, is disposed on the side of the profiles 2.1 and 2.2 that faces away from the air flow.

We claim:

1. A grease filter, comprising:

impact filter elements having:

a first row of elongate profiles disposed at distances from one another;

a second row of profiles disposed at distances from one another;

at least some of said profiles having sound-absorbing material; and at least one filter selected from the group consisting of a knitted fabric filter and an expanded mesh grid, said at least one filter being disposed between said first and second rows of profiles; and said first and second rows of profiles:

being disposed at a distance from one another; and being offset relative to one another to match said profiles of said second row with said distances between said profiles of said first row.

2. The grease filter according to claim 1, wherein:

each of said profiles of said first row in trough-shaped;

each of said profiles of said first row has longitudinal edges pointing in a direction of said filter;

each of said profiles of said second row is trough-shaped; and each of said profiles of said second row has longitudinal edges pointing in a direction of said filter.

3. The grease filter according to claim 1, wherein:

each of said profiles of said first row has edge regions;

each of said profiles of said second row has edge regions; and said profiles of said first row and said profiles of said second row overlap one another in said edge regions and, at the same time, maintain a distance with said filter.

4. The grease filter according to claim 1, wherein:

each of said profiles of said first row has edge regions;

each of said profiles of said second row has edge regions; and said profile, of said first row and said profiles of said second row overlap one another in said edge regions and, at the same time, maintain a distance with said filter such that said profiles of said first row are overlapped in their respective edge regions by said profile of said second row disposed therebehind.

5. The grease filter according to claim 1, wherein said sound-absorbing material is sound-absorbing mats disposed on a side of said profiles facing away from air flow.

6. A grease filter, comprising:

impact filter elements having:

a first row of elongate profiles disposed at distances from one another;

a second row of profiles disposed at distances from one another;

at least one filter selected from the group consisting of a knitted fabric filter and an expanded mesh grid, said at least one filter being disposed between said first and second rows of profiles; and said first and second rows of profiles and said filter having a common frame; and said first and second rows of profiles:

being disposed at a distance from one another; and being offset relative to one another to match said profiles of said second row with said distances between said profiles of said first row.

7. The grease filter according to claim 6, wherein said filter has a frame that can be pushed into the common frame.

8. A grease filter, comprising:

at least one impact filter element having:

a filter flow direction;

a first row of elongate profiles separated from one another to define first spaces therebetween;

a second row of profiles separated from one another to define second spaces therebetween;

at least some of said profiles having sound-absorbing material; and at least one filter selected from the group consisting of a knitted fabric filter and an expanded mesh grid, said at least one filter being disposed between said first and second rows of profiles; and said first and second row of profiles:

being disposed at a distance from one another; and being offset relative to one another to align said profile of said second row with said first spaces in said filter flow direction.

9. The grease filter according to claim 8, further comprising a common frame holding said first and second rows of profiles and said filter.

10. The grease filter according to claim 8, wherein:

each of said profiles of said first row is trough-shaped; and each of said profiles of said first row has longitudinal edges pointing in a direction of said filter.

11. The grease filter according to claim 10, wherein:

each of said profiles of said second row is trough-shaped; and each of said profiles of said second row has longitudinal edges pointing in a direction of said filter.

12. A grease filter, comprising:

impact filter elements having:

a first row of elongate profiles disposed at distances from one another;

a second row of profiles disposed at distances from one another; and at least one filter selected from the group consisting of a knitted fabric filter and an expanded mesh grid, said at least one filter being disposed in a meander-shaped manner between said first and second rows of profiles; and said first and second rows of profiles:

being disposed at a distance from one another; and being offset relative to one another to match said profiles of said second row with said distances between said profiles of said first row.

13. The grease filter according to claim 12, wherein, in each respective edge region of said profiles of said first row, there in a change to an edge of said profile of said second row lying therebehind.

14. The grease filter according to claim 12, wherein:

each of said profiles of said first row has edge regions;

each of said profiles of said second row has edge regions; and in each respective edge region of said profiles of said first row, there is a change to an edge of said profile of said second row lying therebehind.

15. A grease filter, comprising:

impact filter elements having:

a first row of elongate profiles disposed at distances from one another;

a second row of profiles disposed at distances from one another;

one of said profiles of said first row and said profiles of said second row being disposed on a downstream side of said impact filter elements with respect to an air flow direction;

at least some of said profiles on said downstream side having sound-absorbing material; and at least one filter selected from the group consisting of a knitted fabric filter and an expanded mesh grid, said at least one filter being disposed between said first and second rows of profiles; and said first and second rows of profiles:

being disposed at a distance from one another; and being offset relative to one another to match said profiles of said second row with said distances between said profiles of said first row.

16. The grease filter according to claim 15, wherein said sound-absorbing material is sound-absorbing mats.

17. A grease filter, comprising:

impact filter elements having:

a first row of elongate profiles disposed at distances from one another;

a second row of profiles disposed at distances from one another; and at least one filter selected from the group consisting of a knitted fabric filter and an expanded mesh grid, said at least one filter being disposed between said first and second rows of profiles;

said filter having a thickness dimensioned to bear at least one of said profiles of said first row and said profiles of said second row on said filter in an assembled state of said filter elements; and said first and second rows of profiles:

being disposed at a distance from one another; and being offset relative to one another to match said profiles of maid second row with said distances between said profiles of said first row.

18. A grease filter, comprising:

impact filter elements having:

a first row of elongate trough-shaped profiles disposed at distances from one another;

a second row of profiles disposed at distances from one another; and at least one filter selected from the group consisting of a knitted fabric filter and an expanded mesh grid, said at least one filter being disposed between said first and second rows of profiles;

said profiles of said first row having longitudinal edges pointing in a direction of said filter; and said first and second rows of profiles:

being disposed at a distance from one another; and being offset relative to one another to match said profiles of said second row with said distances between said profiles of said first row.

19. A grease filter, comprising:

impact filter elements having:

a first row of elongate profiles disposed at distances from one another;

a second row of trough shaped profiles disposed at distances from one another; and at least one filter selected from the group consisting of a knitted fabric filter and an expanded mesh grid, said at least one filter being disposed between said first and second rows of profiles;

each of maid profiles of said second row having longitudinal edges pointing in a direction of said filter; and said first and second rows of profiles:

being disposed at a distance from one another; and being offset relative to one another to match said profiles of said second row with said distances between said profiles of said first row.

* * * * *